United States Patent [19]

Schneider et al.

[11] Patent Number: 4,851,253

[45] Date of Patent: Jul. 25, 1989

[54] OPERATING-CONTROL METHOD FOR AN ELECTROSTATIC COATING INSTALLATION

[75] Inventors: Rolf Schneider, Burgstetten; Fred Luderer, Leutenbach; Peter Henger, Sachsenheim, all of Fed. Rep. of Germany

[73] Assignee: Behr Industrieanlagen GmbH & Co., Fed. Rep. of Germany

[21] Appl. No.: 169,314

[22] Filed: Mar. 17, 1988

[30] Foreign Application Priority Data

Mar. 23, 1987 [DE] Fed. Rep. of Germany ..... 3709510

[51] Int. Cl.[4] ..... B05D 1/04

[52] U.S. Cl. ..... 427/8; 427/27

[58] Field of Search ..... 427/8, 27; 118/671, 118/629, 712, 663, 713

[56] References Cited

U.S. PATENT DOCUMENTS 3,875,892 4/1975 Gregg et al. ..... 118/629 X 4,266,262 5/1981 Haase, Jr. ..... 118/663 X

*Primary Examiner*—Evan Lawrence

*Attorney, Agent, or Firm*—Reising, Ethington, Barnard, Perry & Milton

[57] ABSTRACT

In the electrostatic coating of workpieces with a coating installation in which material sprayed from a grounded rotary sprayer is electrically charged in the corona-discharge area by external electrodes inducing a corona-current to the sprayed material, the danger of the spraying device coating itself is reduced if the corona-current is adjusted to a predetermined value.

10 Claims, No Drawings

OPERATING-CONTROL METHOD FOR AN ELECTROSTATIC COATING INSTALLATION

TECHNICAL FIELD

The invention relates to a method for an electrostatic coating installation in which the coating material is atomized by a spraying device and charged in the corona discharge with the aid of electrodes which are connected to a high-voltage generator having a variable voltage.

BACKGROUND ART

In the electrostatic coating of workpieces, for example vehicle bodies, it is known, and common practice, to pass the workpieces in series through spray-booths in which rotary sprayers, connected individually or in groups to high-voltage generators, are installed. In conventional installations, the coating material was raised to the high-voltage potential directly in or on the atomizer. However, in order that the presently preferred coating materials having higher electrical conductivity may be used, like the so-called water-enamels, it is better to ground the entire enamel feed-system and the atomizing bell, or the like, and to charge the mechanically atomized paint particles by means of the external electrodes surrounding the atomizing bell. Reference of such may be had in German OS 34 290 075 and 36 09 240. Charging is effected by ion-capture occurring in the corona-discharge through the electrode tips.

When an installation of this kind was in operation, it was hitherto customary to stabilize the voltage from the high-voltage generator, applied to the spraying devices, at constant values which, in order to take account of the relative operating conditions, could be adjusted in steps, for example over the range between 60 and 100 kV. If the voltage is held to a constant value, problems arise, especially in connection with the previously mentioned external charging of the coating material in the corona-discharge, since, under certain circumstances, considerable fluctuations in the corona-current could occur while the unit was in operation. The corona-current is distinctly higher than the operating current normally used during conventional contact-charging of the coating material on the atomizer. The corona-current is not only dependent upon the voltage potential at the electrode, but also upon various environmental conditions such as atmospheric humidity and contamination about the electrode area. For example, in a typical coating installation of the type in question, the corona-current may fluctate between 100 and 300 uA when atmospheric humidity varies between 30 and 90%. However, both unduly high and unduly low corona-currents must be avoided. In the case of unduly high corona-currents, adequate ionization fails to occur, resulting in unsatisfactory coating efficiency (the coating efficiency being the ratio between material sprayed and material reaching the workpiece). In the case of unduly low corona-current, there is a danger of overloading the paint mist with space-charging effects which, according to experience, may almost completely suppress the corona-current and ionization. In both cases, as a result of inadequate charging of the paint-particles, there may be rapid contamination of the electrodes, of their holders and of other parts of the atomizer by the material sprayed. Additional problems arise as a result of the pronounced dependency of the corona-current upon voltage fluctuations which result in substantially greater current changes when compared with the relatively minor current changes resulting from voltage fluctuations in the conventional contact charging methods utilizing a lower operating current. Such current-changes are undesirable in practice.

It is known from German OS 34 45 946, in electrostatically coating large workpieces, such as vehicle bodies, to switch the installation off automatically, in order to avoid a voltage breakthrough between the workpiece and the coating device, as soon as the operating current reaches a threshold value which is predetermined as a function of the operating voltage which is adjustable within a certain range. In such an operation, all current threshold values corresponding with their operation voltage-values are stored jointly, more particularly in a microprocessor, and are automatically selected, when the unit is in operation, in accordance with the voltages set. Initially, a warning signal only may be produced when the current, which is measured constantly while the unit is in operation, exceeds an intermediate threshold value between the normal value and the switch-off threshold value.

In the case of a method known from German OS 24 51 818 for the electrostatic coating of workpieces moving at variable distances past spray-discs carrying high voltages, the voltage is held constant until a specific distance is not reached and an adjustable current maximum is reached. Thereafter, for the purpose of limiting the field-strength between the spray-disc and the workpiece, the current is temporarily held constant until the high voltage applied is finally switched off when an adjustable minimal distance is not reached. Apart from the deficiency with this method that the coating material is not at ground potential during spraying and it is not charged in the corona-discharge, all that this method provides is a limit to a maximal current-value which need not be reached during normal operation, depending upon the spacing. The previously mentioned contamination about the electrode may therefore occur, especially during changes in atmospheric humidity and other environmental conditions.

SUMMARY OF THE INVENTION AND ADVANTAGES

The subject invention provides an operating control method for an electrostatic coating installation in which an electrically conductive coating material at ground potential is atomized by a spraying device and charged in a corona-discharge area about the spraying device by electrodes supplied with an operating current and a voltage from a high-voltage generator having a variable high voltage output. The method comprises the steps of measuring the discharge of coating material from the spraying device, and measuring the operating current. The invention is characterized by including the step of holding the operating current to a predetermined value when the coating installation is in operation.

The present invention provides a method which largely avoids self-contamination of the spraying device and, more particularly, about the electrode area during operation.

DETAILED DESCRIPTION OF THE PREFERRED EMBODIMENT

By maintaining predetermined, usually constant, operating current values during normal operation, i.e., not as a function of distance between the workpiece and the spraying device, it is possible to compensate for variable environmental conditions. Particularly, the effect of atmospheric humidity (water-vapour content) upon corona-discharge can be compensated for. This is advantageous in that, when the unit is in operation, optimal charging of the paint particles at the corona-discharge is assured at all times. Optimal charging of the paint particles is desired so that the largest possible number of sprayed paint-particles are charged and pass to the workpiece to be coated, instead of being deposited upon the spraying device itself. With a deposit reducing insulation it is possible, at the same time, to avoid current measuring problems arising from shunt-currents.

Under normal circumstances, keeping the operating current constant requires a closed control-circuit in which the measured current represents the control-factor and the controller produces an adjustment-factor for controlling the electrode-supply voltage, according to the deviations of the control-factor. In practice, therefore, there will be a continuous change in the voltage of the cascade, or the like, forming the high-voltage generator, and thus in the field-strength between the electrodes and the workpiece to be coated. An alternative operating method comprises controlling the high-voltage generator as a direct function of atmospheric humidity to produce a constant corona-current.

Furthermore, the predetermined current-value to be maintained must not be the same for all operating conditions. In the event of extremely dry air in the spray-booth in particular, it may be desirable to establish a constant value which is different from that for extremely humid air. The same applies to other variable environmental conditions, such as the spatial relationship between the spraying device and the workpiece, for example. Accordingly, these variable environmental conditions must be measured during the coating operation. For these reasons, it may also be desirable to vary the predetermined current-value as a function of atmospheric humidity and/or other environmental conditions.

If the electrode-supply voltage must be altered in order to keep the operating current constant, these alterations provide information as to direct or defective operation. For instance, in the event of a short-circuit, increasing contamination, or an approach of the workpiece to the spraying device presaging a voltage breakthrough, the current tends to rise sharply and this may be counteracted by a corresponding reduction in voltage. The electrode-supply voltage is measured constantly. If it fails to reach a limiting value, a warning signal may be produced and/or the coating installation may be switched off. Under certain circumstances, the limit voltage-value may be adjusted as a function of the relevant operating conditions and may be altered automatically. A warning signal may also be given if the supply-voltage varies rapidly during control, or if the operating current itself varies, within a predetermined time, by a more than acceptable amount, for example if the current-control fails or operates too sluggishly. Finally, an unduly high operating voltage may release a defect report.

The described setting of the corona-operating current to a specific, usually constant value is effected during the normal coating operation. On the other hand, after the installation has been started and, until the desired current-value is reached, the measured operating current may be monitored by comparison with predetermined voltage-dependent data, to determine whether it falls below, or more particularly exceeds, permissible values, preferably as disclosed in previously mentioned German OS 34 45 946. In the event of unacceptable deviations in the current, a warning signal is given or the installation is switched off. If the required current value is reached without encountering unacceptable deviations, then the current-control is switched on and it is determined if the supply-voltage remains above the minimal value prescribed. Changing the installation over from current-threshold-value operation to constant-current operation may be carried out automatically, for example by exceeding a predetermined voltage in the high-voltage generator after the latter has been switched on.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An operating-control method for an electrostatic coating installation in which an electrically conductive coating material at ground potential is atomized by a spraying device and charged in a corona-discharge area about the spraying device by electrodes supplied with an operating current and a voltage from a high-voltage generator having a variable high voltage output, said method comprising the steps of measuring the operating current, and characterized by including the step of holding the operating current to at least one predetermined value when the coating installation is in operation.

2. A method as set forth in claim 1 further characterized by holding the operating current to one constant predetermined value.

3. A method as set forth in either of claims 1 or 2 further characterized by controlling the operating current by regulating the voltage supplied to the electrodes.

4. A method as set forth in claim 3 further characterized by varying the operating current supplied to the electrodes as a function of the variable environmental conditions.

5. A method as set forth in claim 4 further characterized by varying the voltage supplied to the electrodes as a function of atmospheric humidity.

6. A method as set forth in claim 3 wherein the coating material is atomized under variable environmental conditions, further characterized by measuring the variable environmental conditions.

7. A method as set forth in claim 1 further characterized by comparing the voltage supplied to the electrodes with a predetermined voltage limit value.

8. A method as set forth in claim 1 further characterized by emitting a warning signal when the voltage supplied to the electrodes fluctuates beyond a predetermined limit while the operating current is held to the predetermined value.

9. A method as set forth in claim 1 further characterized by emitting a warning signal when the operating current supplied to the electrodes fluctuates beyond a predetermined limit.

10. A method as set forth in claim 1 further characterized by comparing the measured operating current with a predetermined voltage dependent value until the operating current reaches the predetermined value, emitting a warning signal in the event the current unacceptably fluctuates before reaching the predetermined value, and holding the operating current to the predetermined value after the predetermined value has been reached and the warning signal has not been emitted.

* * * * *